US007614441B2

(12) United States Patent
Lauener et al.

(10) Patent No.: US 7,614,441 B2
(45) Date of Patent: Nov. 10, 2009

(54) CASTING MACHINE

(75) Inventors: Wilhelm Friedrich Lauener, Gerlafingen (CH); Martin Lauener, Winistorf (CH)

(73) Assignee: Lamec AG, Recherswil (CH)

( * ) Notice: Subject to any disclaimer, the term of this patent is extended or adjusted under 35 U.S.C. 154(b) by 536 days.

(21) Appl. No.: 10/597,053

(22) PCT Filed: Jan. 14, 2004

(86) PCT No.: PCT/CH2004/000014

§ 371 (c)(1),
(2), (4) Date: Jul. 10, 2006

(87) PCT Pub. No.: WO2005/068108

PCT Pub. Date: Jul. 28, 2005

(65) Prior Publication Data

US 2007/0102135 A1 May 10, 2007

(51) Int. Cl.
*B22D 11/06* (2006.01)
*B22D 27/02* (2006.01)

(52) U.S. Cl. ..... 164/479; 164/148.1; 164/430

(58) Field of Classification Search ..... 164/479, 164/481, 430–431
See application file for complete search history.

(56) References Cited

U.S. PATENT DOCUMENTS

| | | | |
|---|---|---|---|
| 3,570,586 | A | 3/1971 | Lauener |
| 4,794,978 | A | 1/1989 | Lauener |
| 5,645,122 | A | 7/1997 | Luginbuhl et al. |
| 5,979,539 | A | 11/1999 | Luginbuhl et al. |

FOREIGN PATENT DOCUMENTS

| | | |
|---|---|---|
| DE | 4121169 | 3/1993 |
| EP | 0798060 | 10/1997 |
| GB | 1388378 | 3/1975 |
| JP | 55-133852 | * 10/1980 |

OTHER PUBLICATIONS

E. Hermann; "Handbuch des Strangglessens" (Handbook on Continuous Casting); Aluminum Verlag Dusseldorf; pp. 51-53; 1958 (discussed on p. 1 of Specification).
E. Hermann, "Handbook on Continous Casting"; Aluminum Verlag Dusseldorf; pp. 3-4, & 171; 1980.

* cited by examiner

*Primary Examiner*—Kuang Lin
(74) *Attorney, Agent, or Firm*—Rankin, Hill & Clark LLP

(57) ABSTRACT

The present casting machine and the underlying caterpillar-mold casting method distinguish themselves by the fact that the blocks (4) forming the mold circulate caterpillar-like around one of the casting caterpillars (2;3) and are subdivided in the lateral direction into individual elements that are held together, the elements, which rest on a transport means, being held on the transport means at least over a part of the circumference of the caterpillar by means of stationary magnets.

26 Claims, 12 Drawing Sheets

CASTING MACHINE

BACKGROUND OF THE INVENTION

The invention relates to a caterpillar-mould casting method as claimed in the characterizing portion of claim 1, to a casting machine as claimed in the characterizing portion of claim 4, and to a method of changing the blocks of a casting machine as claimed in claim 26.

Machines of this type are used in the continuous fabrication of billets and bands, hereinafter referred to as 'strand', consisting in particular of aluminium and its alloys, but also of other materials such as zinc, copper, brass, and steel, as well as a number of non-metallic materials.

The development of methods and apparatuses for this purpose goes back to the previous century and even the century before. Reference is made here to the works of E. Hermann, "Handbuch des Stranggiessens" (Handbook on Continuous Casting), 1958, and "Handbook on Continuous Casting", 1980 (Aluminium Verlag, Düsseldorf). As these works show, there have been conceived, among other types, casting machines in which the casting mould where the solidification of the melt takes place is formed by metal blocks extending over the width of the mould.

In order to minimise friction between the solidifying melt and the casting mould, the blocks move along with the solidifying strand at the same speed until they reach the end of the mould where they are detached from the strand and directed, by means of chain wheels or arcuate tracks, to the rear of the machine body where they undergo a second change of direction so as to be redirected again to the entry of the mould.

Said blocks may be made of antimagnetic or ferromagnetic material, preferably copper or aluminium, or of cast iron or steel, depending on the particular operating requirements.

In American terminology, casting apparatuses of this type are referred to as machines with caterpillar-mould or as block-casters.

Mounted on caterpillar tracks and moved by a transport mechanism, these blocks circulate around a machine body, with one design including two opposed machine bodies which are positioned in such a way that the distance between the walls facing one another in the mould corresponds to the thickness of the strand to be cast, taking into consideration the shrinking of the melt as it solidifies.

Another design is distinguished by the fact that the machine includes only one machine body around which a caterpillar circulates, the melt being poured onto the caterpillar where it continuously solidifies into a strand. Preferably, the solidifying strand is covered by a gas schrouding in order to prevent unwanted oxidation from taking place on the free upper surface of the solidifying melt.

The following description refers in particular to machines having two opposed machine bodies and two caterpillars. As far as the design and function of the machine bodies and the caterpillars are concerned, the novelty described hereinafter is also applicable to machines having only one machine body provided with a caterpillar moving around it.

In operation, the melt prepared in a furnace flows through a channel into a trough arranged on the inlet side of the mould which extends over the width of the mould and in which the metal level is kept at a required height through controlled material supply. From here, the melt is led through pouring nozzles into the mould which is delimited on the entry side by said nozzle, on the exit side by the solidifying strand and laterally by side dams. The casting direction may be vertical, horizontal or inclined.

The speed of the strand leaving the mould depends on the material and the thickness of said strand as well as on the physical properties of the block material and on the temperature thereof at the entry of the mould. The strand thickness usually obtained with caterpillar-mould casting machines is between 1.5 and 3 cm, preferably 2 cm. The speed of the strand when leaving the machine must be controlled and adapted depending on the particular operating conditions and is normally between 2 and 12 m/min. After it has left the machine, the produced strand undergoes further manufacturing processes in a manner known in the art.

In the section where they form the mould, the blocks are in contact with the melt, taking up the heat to be absorbed therefrom, and are then cooled by means of an aqueous coolant while travelling around the machine body. Experience has shown that the thickness of the blocks is between three and five times the thickness of the strand to be cast, depending on the amount of heat to be stored.

For reasons of a purely physical nature, known caterpillar-mould casting machines are flawed by one big problem.

The unilateral heating to which they are exposed when passing through the mould section causes the blocks to be deformed in an unwanted manner, i.e. they will become subject to distortions the degree of which is aggravated with an increasing length of the blocks. This will cause the walls of the mould to become uneven, which in designs known so far leads to the formation of local gaps between the mould wall and the solidifying strand. In addition to causing an uneven thickness of the strand produced, these gaps will lead to an uncontrollable heat flow from the melt into the mould wall, giving rise to excessive local thermal stresses in the solidifying material which may in turn lead to intolerable cracks in the nascent structure of the strand. In addition, the joints at the abutting faces of the successive blocks tend to become loose, which causes ledges and fins on the surface of the strand, as the melt flows into the interstices and gaps formed in the mould wall.

There is also the problem of sealing the casting nozzle protruding into the mould, as a reverse flow of the melt must imperatively be prevented. The sealing will evidently be the more difficult to achieve the more the blocks are deformed.

Heat stresses increase considerably if the subsequent cooling of the blocks takes place on the surface that has previously been in contact with the melt, hereinafter referred to as front surface.

Depending on the height of the temperature difference between heated and cooled surfaces, the compression stresses and tensile stresses periodically occurring on this surface may fall out of the elastic limit of the block material, which due to material fatigue leads to reticulated cracks on the front surface of the blocks, which in turn has a negative effect on the surface of the cast product—a circumstance which requires an exchange and a remachining of the blocks used after a relatively short operating period.

Due to the above-mentioned high thermal stress experienced by the blocks, the latter are generally to be considered as wearing parts that have to be periodically replaced by remachined or new blocks.

Although caterpillar-mould casting machines are provided with evident advantages over other continuous casting processes as far as the quality of the product is concerned, machines of the types used so far—due to the problems mentioned above, and with the exception of the machine described hereinafter-have been able to stand their ground only for the production of relatively narrow strands, since the problems described dramatically increase with the use of moulds having greater widths.

From the U.S.-Patents U.S. Pat. No. 3,570,586 and U.S. Pat. No. 5,979,539, apparatuses are known which try to prevent warping of the blocks even when used with wide-moulded machines by mounting the beam-like blocks reaching over the width of the mould by means of strong fasteners onto rigid steel supports having practically a constant temperature and the geometrical moment of inertia of which is a multiple of that of the blocks, whereby an excessive deformation of the blocks can largely be avoided. The cooling of the blocks is done during their return travel by spraying an aqueous coolant onto the mould walls. This known concept allows a considerable increase in the machine width as compared to other designs, making it possible, with the use of new or remachined blocks, to manufacture for a limited period of time alloyed aluminium strands of good quality with a width of up to 1.8 m. This result is due to the fact that not only the evenness of the mould walls is maintained by force, but their temperature can be well controlled, due to the relatively high mass of the blocks, by adjusting the cooling system, which allows the solidification process of the material to be cast to take place in an optimal way, so that besides the achieved product quality improvement it is also possible to work with a wider variety of metallic materials and their alloys.

Years of experience have shown, however, that the aforementioned problems have only been partially solved with the concept of the support-mounted blocks just described. Since the blocks are prevented from being deformed upon temperature changes, heavy internal strains will build up in them, according to the laws of physics concerning the strength of materials, and these forces will interfere with thermal stresses of the same modulus which are present anyway in the mould walls so that material fatigue accompanied by the formation of cracks is dramatically accelerated. As subsequent to the heating of the blocks, the same surface that used to be in contact with the melt is sprayed with coolant, the aforementioned effect is even considerably aggravated. In addition, experience shows that the blocks, despite their fixation on rigid supports will nevertheless, after a certain operating time, show distortions, which have a negative influence on the quality of the product, as discussed above. The inadmissibilities mentioned above will result in the need for the blocks to be changed after a relatively short period of operation which, due to the strong fixation of the blocks on the heavy supports, is a very labour-intensive task which involves substantial machine downtime and thus represents a substantial drawback as far as the economy of the plant is concerned.

From the findings available and from experience with caterpillar-mould casting machines, it becomes evident that a further development of these machines in order to solve the problems still remaining is of great importance to the industrial branch concerned, since the casting method in question—once properly improved—provides manifest advantages over other casting types as far as economic aspects as well as the diversity of materials and alloys to be treated and the quality of the product are concerned. It was found that successful operation is only possible if the following conditions are fulfilled:

A) The design concept of the machine must be appropriate for the production of high-quality strands of any width required by the industry.

B) The changing of the blocks must be possible within a small fraction of the time it currently takes, in order to limit the amount of work involved and the downtime of the entire production plant to a minimum.

C) The service life of the blocks must be substantially increased as compared to their current useful life.

Experience shows that in order to meet the requirement of a uniform solidification process of the nascent strand and, consequently, of a proper heat flow from the latter into the wall of the mould, the deformation of the blocks during their passage through the mould must not exceed one or two tenths of a millimeter, depending on the solidification characteristics of the melt.

According to the laws of physics, the change in absolute shape and dimensions of a free body depends on the size of said body, the expansion coefficient of the material in question, and on the temperature conditions involved. If, for example, an elongated body with a rectangular transverse section, which is the form of the blocks of conventional caterpillar-mould casting machines, is characterised with respect to the central line extending in the longitudinal direction of the body by an asymmetrical temperature profile over its cross-section, said body will react with a deflection. While the length measure of a long body as compared to a short body will increase in a linear manner, the increase in terms of the absolute measure of the deflection is approximately raised to the second power of the aspect ratio of the compared bodies, with the cross-sections of the respective bodies and the temperature profile remaining identical.

U.S. Pat. No. 3,570,586 discloses a practice that consists in subdividing the beam-like blocks extending over the width of the mould into relatively small segments, referred to hereinafter as block elements, to join them together in the lateral direction by means of connecting rods, and to mount the blocks formed in this way, the rigidness of which is reduced as compared to one-piece blocks, onto rigid support members of practically constant temperature, which makes it possible to largely avoid deformations due to temperature changes of the blocks.

This known block structure, however, turns out to be too costly since the blocks are wearing parts that are to be replaced at regular intervals. In addition, it appeared that in operation the elements are displaced due to the constant changes in temperature, so that in the long run the required evenness of the blocks cannot be ensured. The expected success of this supposed solution is thus to be considered as illusory and this method is not apt to go into operation.

In addition, as mentioned above, the concept of exchanging the blocks involves a great amount of work and, consequently, an extended downtime period of the entire production line, particularly due to the necessity to detach said blocks from their support members and to re-mount them thereon. In addition, due to their strong fixation upon their respective support member, the block elements are prevented from undergoing free deformation upon temperature changes, which, as mentioned before, causes additional stresses within the elements and thus negatively influences their service live.

The invention is intended to provide a remedy for this. It is accordingly an object of the invention to provide a casting machine that is capable of fulfilling the conditions mentioned under (A), (B), and (C) for an economically successful utilisation of caterpillar-mould casting machines.

BRIEF SUMMARY OF INVENTION

According to the invention, this object is achieved by means of a caterpillar-mould casting method that shows the features of claim 1, as well as a casting machine that shows the features of claim 4, and a method for exchanging the blocks of a casting machine that shows the features of claim 26.

The advantages achieved by the invention reside essentially in the fact that due to the casting machine of the invention

- the mould walls remain even while the blocks travel through the casting zone so that a controlled cooling and a uniform thickness of the nascent strand will result over the entire width and length thereof, a prerequisite enabling the method to be used in the production of high-quality products using alloyed material in any width required by the industry;
- the changing of the blocks may be done within a small fraction of the time it currently takes to do so, and thus
- the amount of work involved and the downtime of the entire production plant may be limited to a minimum.

In a preferred embodiment of the invention, the ratio between the portion t on which the blocks are held on the transport means by means of the stationary magnets and the total circulation path U of the respective casting caterpillar, t: U, is between 0.55 and 0.95. The advantage thus achieved resides in the fact that the blocks are held on the transport means by the stationary magnets only in those regions in which, due to gravity, they would otherwise fall away from the transport means. On the part of the circulation path where no stationary magnets are mounted, the blocks may be lifted off from the transport means by means of a hoisting equipment without the need to detach any fastening means.

Further advantageous embodiments of the invention are characterised in the dependent claims.

In the following, the invention and improvements of the invention will be illustrated in greater detail with reference to the partially diagrammatic representations of several embodiments.

DETAILED DESCRIPTION OF THE INVENTION

The following description refers to machines having two opposed machine bodies and caterpillars, and to a horizontal or a slightly inclined casting direction, but it applies, roughly speaking, also to machines with a vertical or a strongly inclined casting direction, as well as to machines with only one caterpillar, as far as the design of the caterpillar and the fastening of the blocks is concerned.

Figure 1:
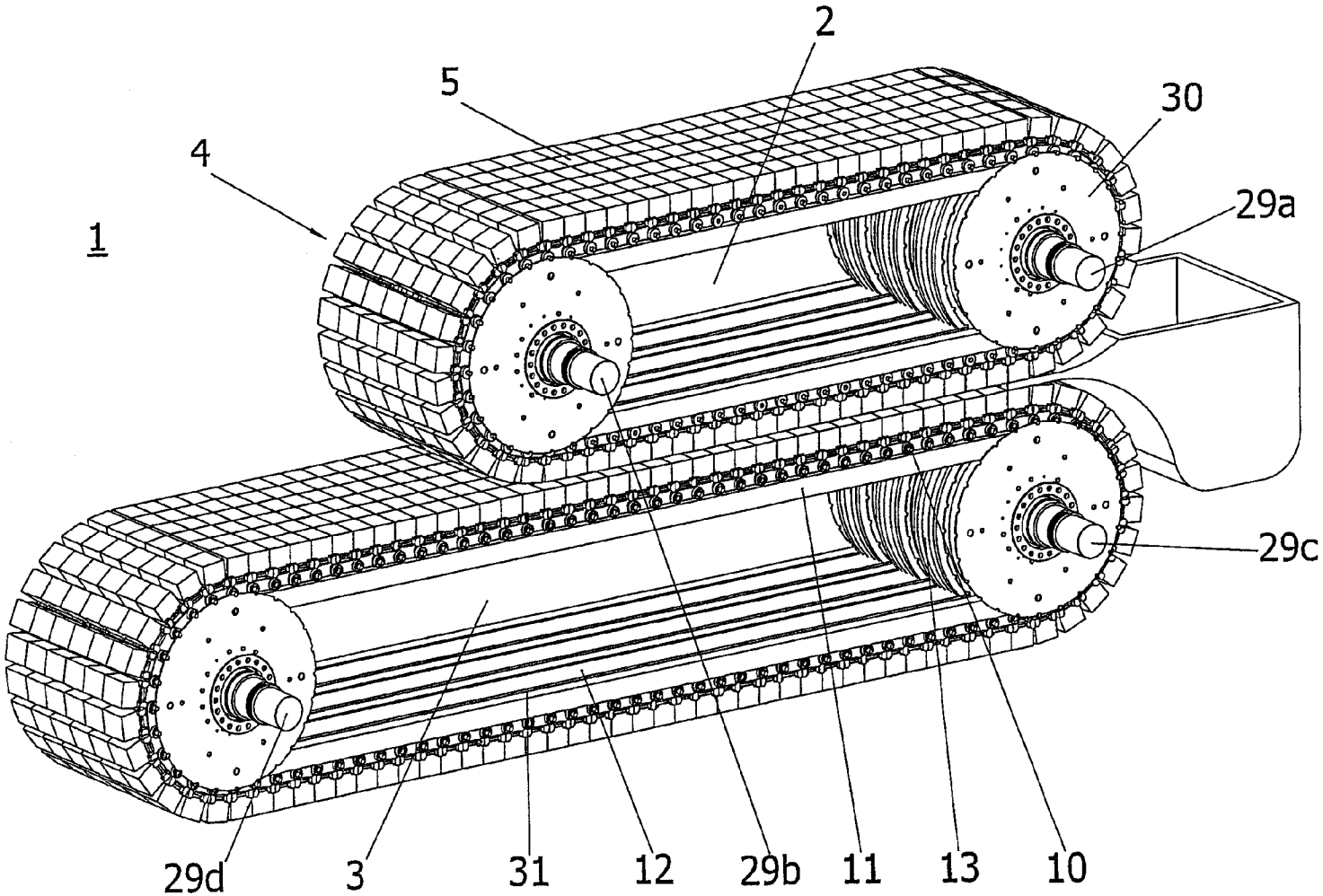
FIG. 1 shows a perspective view of an embodiment of a casting machine according to the present invention having two casting caterpillars.

The overall structure of the casting machine 1 described herein is shown in FIG. 1. In a conventional manner, i.e. by means of a nozzle, the liquid melt is guided into the mould which is formed by the blocks 4 that are moved by a drive not represented in the drawing and circulate caterpillar-like around an upper and a lower casting caterpillar 2;3. On both sides, the mould is closed, according to the state of the art, by means of stationary or also mobile, melt-accompanying side dams not represented in the drawing.

Figure 6:
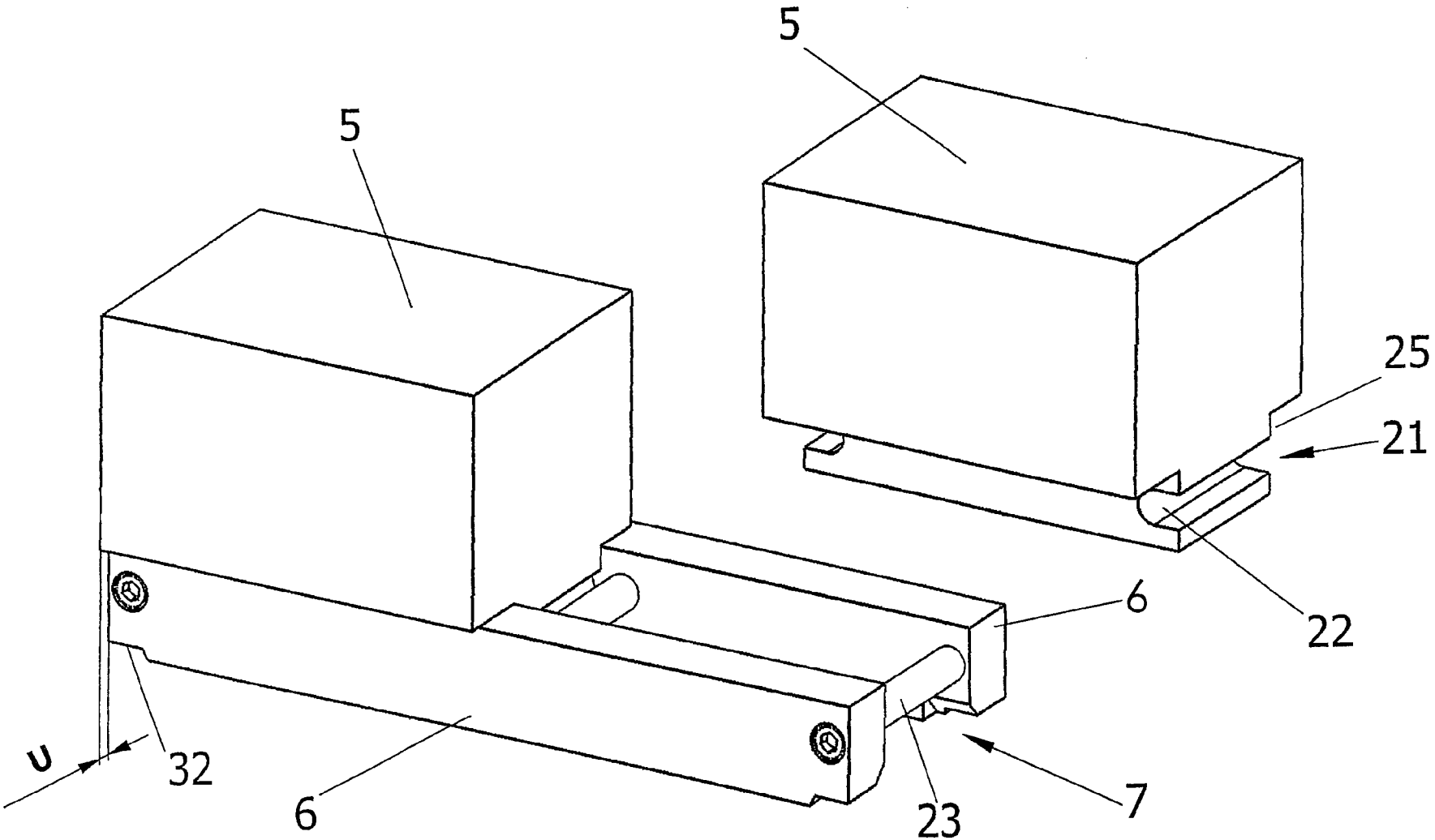
FIG. 6 shows a perspective view of a frame with two block elements of one embodiment of the casting machine according to the present invention.
Figure 7:
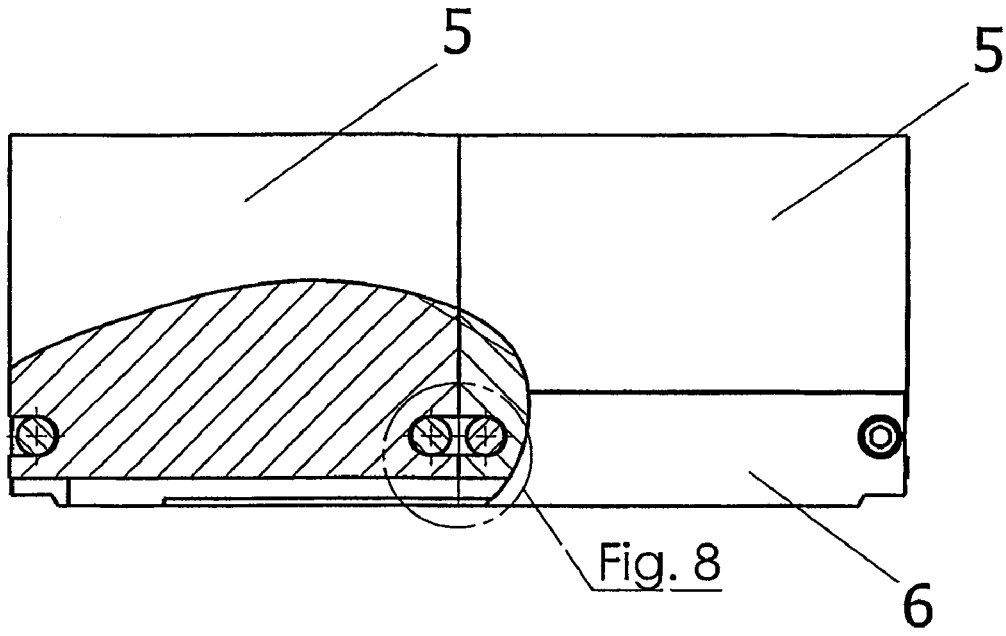
FIG. 7 shows a local section of a frame equipped with two block elements in accordance with the embodiment of the casting machine according to the present invention as represented in FIG. 6.
Figure 8:
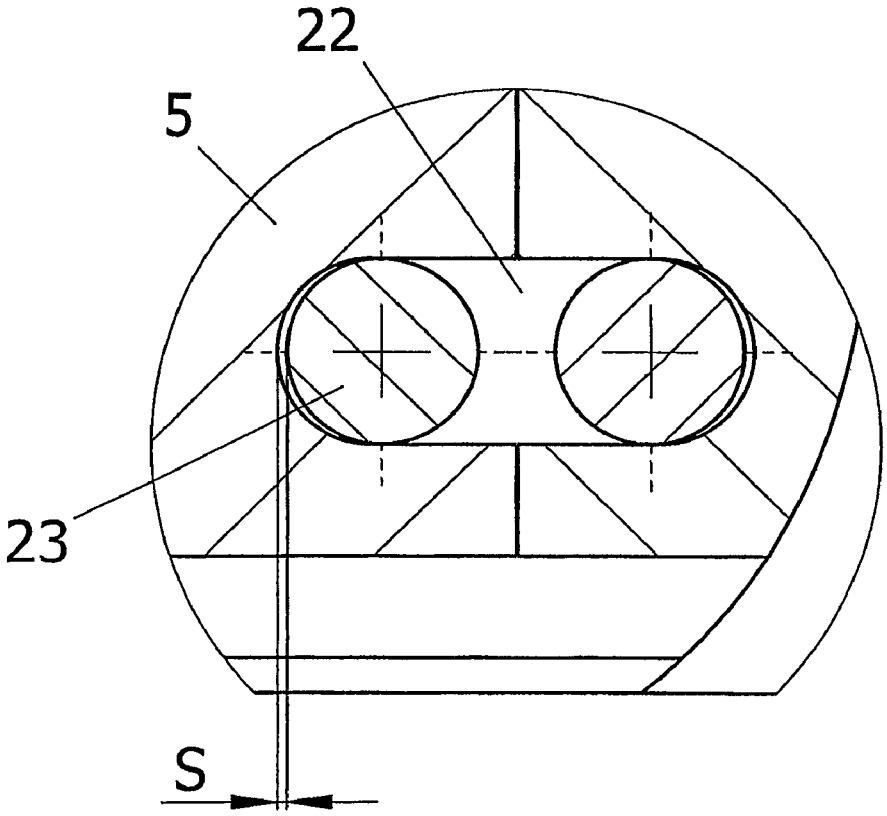
FIG. 8 shows an enlarged detail of the local section represented in FIG. 7.
Figures 9, 10:
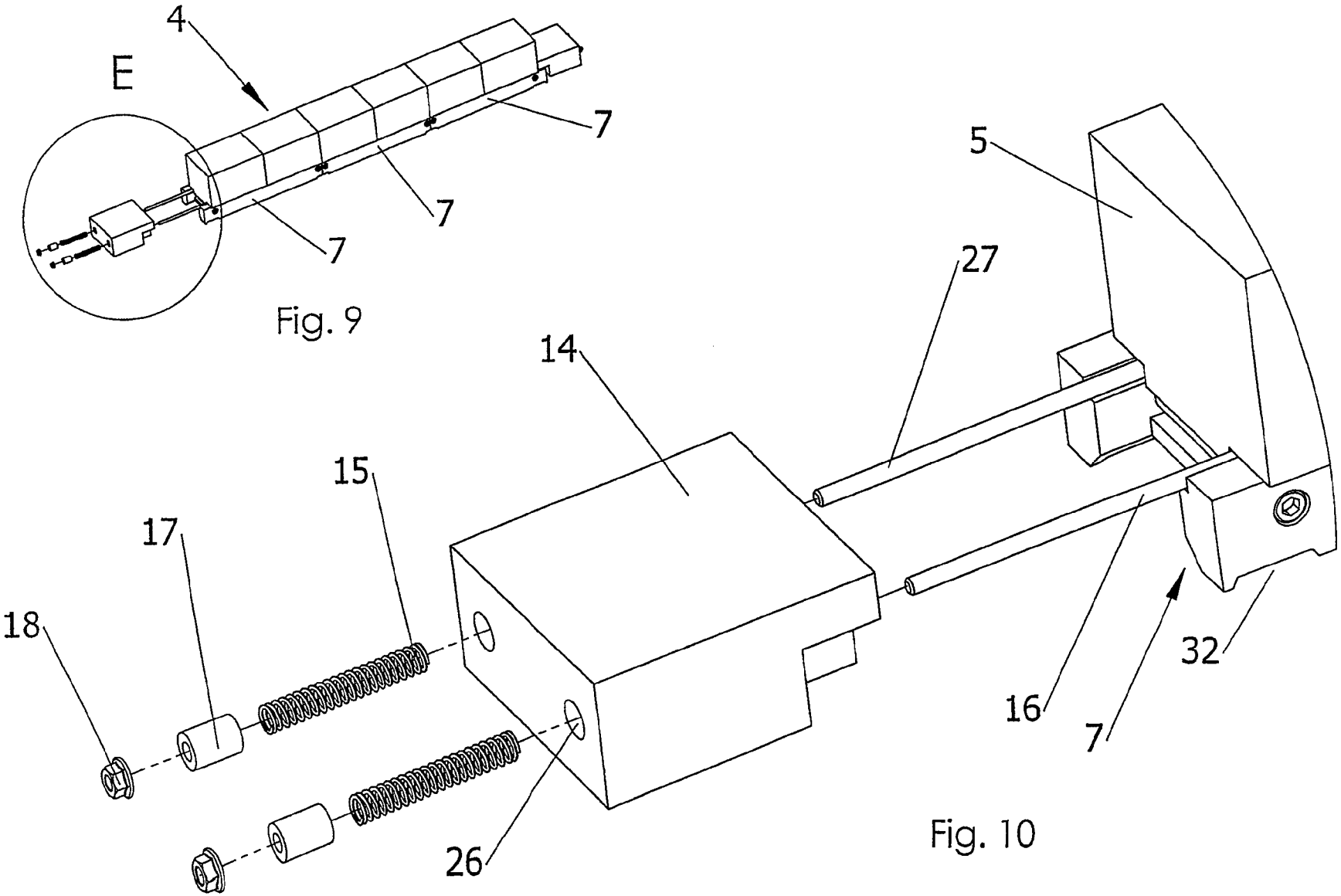
FIG. 9 shows a perspective view of a crosshead with blocks in accordance with one embodiment of the casting machine according to the present invention.
FIG. 10 shows an enlarged detail corresponding to the indication E of FIG. 9.
Figure 12:
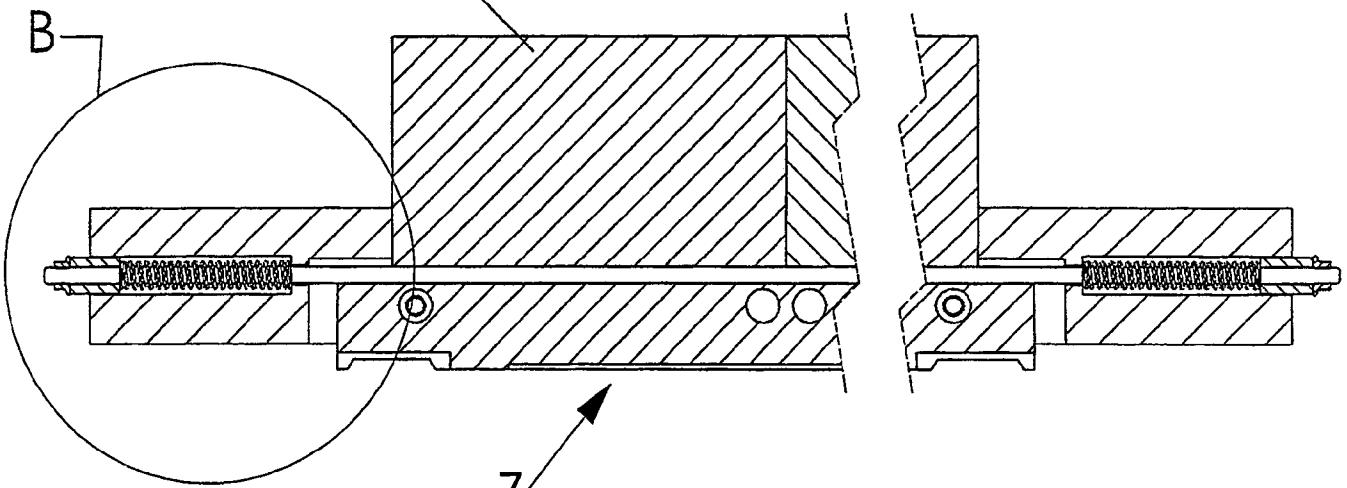
FIG. 12 shows a section along the line A-A of FIG. 11.
Figure 11:
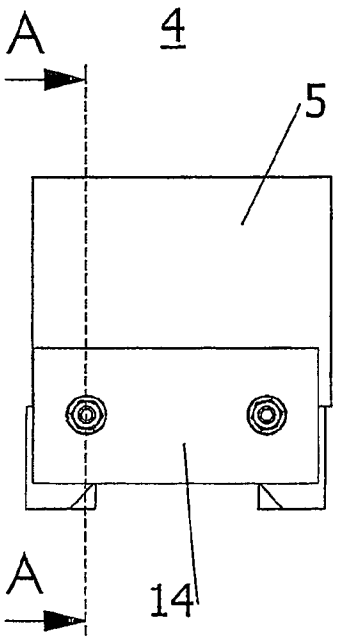
FIG. 11 shows a lateral view of a block in accordance with the embodiment of the casting machine according to the present invention represented in FIGS. 9 and 10.
Figure 13:
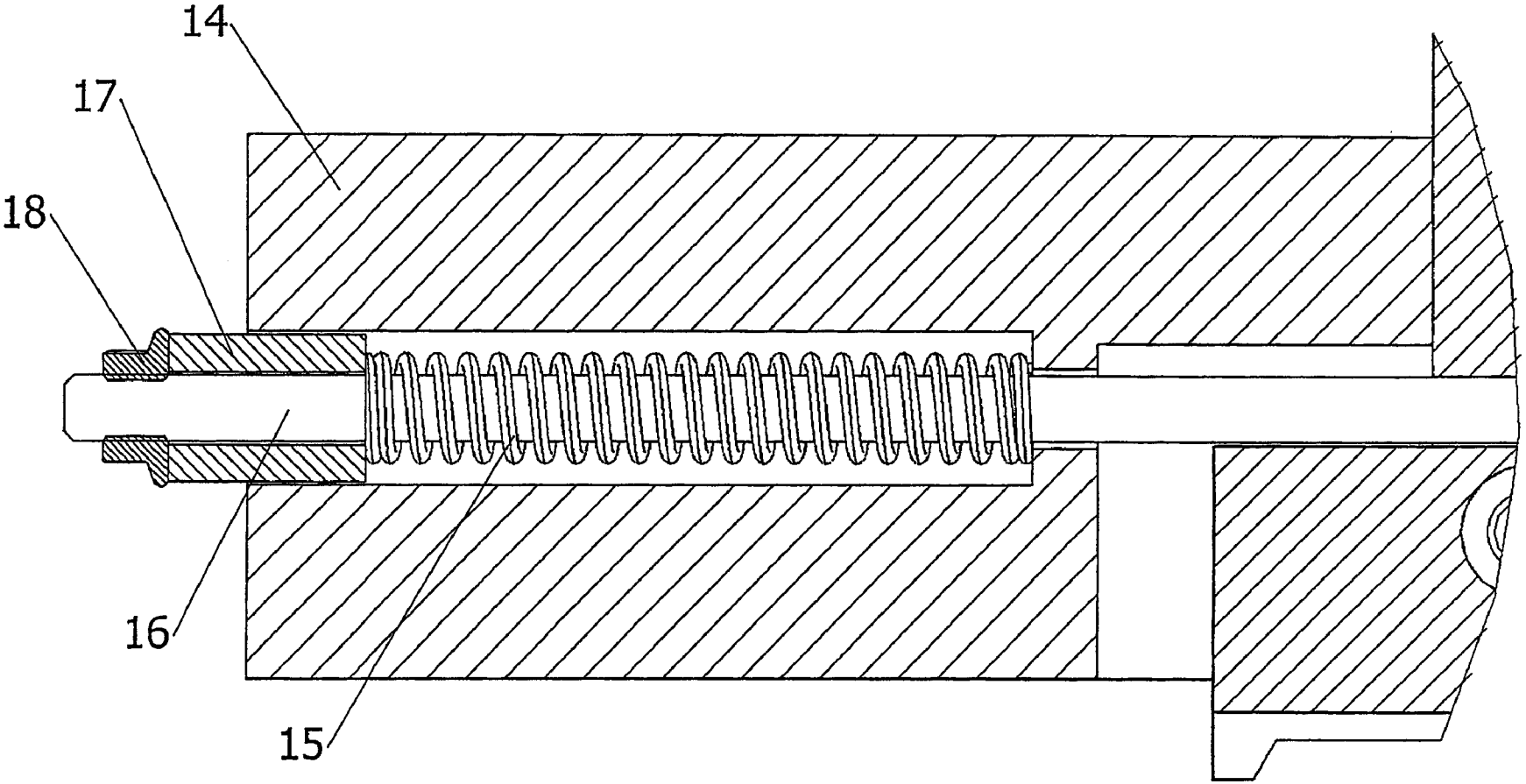
FIG. 13 shows an enlarged detail corresponding to the indication B of FIG. 12.

As shown in FIGS. 6 and 7, two laterally adjoining block elements 5 are, for example, fastened together by means of frames, with provisions being made to compensate for their thermal expansion. Each frame 7 comprises two bar-shaped crossheads 6 of a ferromagnetic material spaced apart from each other in the longitudinal direction of the casting caterpillars 2;3 and arranged in a lateral direction which are held together by means of threaded cross connections 23 arranged in the longitudinal direction of the casting caterpillars 2;3. Between two crossheads 6, one or several block elements 5, depending on the width of the casting zone, are inserted in such a way that the securing grooves 22 formed in the securing members 21, which extend in the longitudinal direction and which are laterally open, may receive the cross connections 23. The lateral distances between the cross connections 23 are such that between said cross connections 23 and the wall of the securing grooves 22 there remains an expansion clearance S in the lateral direction (FIG. 8). This configuration of the frames 7 ensures that the block elements 5 may laterally expand within the frames 7 without being hampered by the cross connections 23. Furthermore, in the region of their securing members 21, the block elements 5 are tapered in the longitudinal direction of the casting caterpillars 2;3 by an amount corresponding to the distance between the bar-shaped crossheads 6.

On their bottom surface, the crossheads 6 are provided with notches 32 by means of which they engage with the chains 10 (FIG. 1).

As shown in FIGS. 9 to 13, the block elements 5 which laterally abut on one another within the frames 7 are resiliently held together by means of draw bars 16 so as to form a block 4 extending over the entire width of the casting caterpillars 2;3. These draw bars 16 extend along the crossheads 6. In order to make it possible for the draw bars 16 to pass the block elements 5, the crossheads 6 have an upwardly tapered form. On the lateral borders of the block 4 thus fit together, the draw bars 16 extend each through a spring hanger 14 mounted on the outer frames 7. The spring hangers 14 are abutted from the outside to the laterally outer block elements 5 and have bores 26 extending in the lateral direction and in which the tension springs 15 that are slid over the draw bars 16 are received. The draw bars 16 have a screw thread 27 formed in the end portion thereof and onto which the biasing nuts 18 may be screwed. In addition, a thrust member 17 is arranged between each of the biasing nuts 18 and the tension springs 15. By means of the biasing nuts 18, the tension springs 15 are axially biased so that the spring hangers 14 are laterally pressed against the blocks 4. Thus the block elements 5 arranged over the width of the casting caterpillars 2;3 are resiliently pressed together and can thus laterally expand against the elastic force of the springs.

The invention described hereinafter resides in the fact that the blocks 4 extending over the width of the mould consist in the lateral direction of several parts, referred to hereinafter as block elements 5, which are positioned within frames 7 made of magnetizable material and are held therein in such a way that they are able to freely undergo deformation on the occurrence of temperature changes. The joined blocks 4 are lodged, as units, on transport means in the form of chains 20 (FIG. 2) preferably provided with chain sprockets 10 (FIG. 15) and circulating on endless paths around their respective machine bodies, stationary magnets, preferably magnetic rails 12 (FIGS. 1 and 5) being disposed between the tracks 11 (FIG. 1) of the chains 20 (FIGS. 2 and 3) and the bottom surface of the casting caterpillars 2;3, and stationary magnetic bows 13 (FIG. 1) being disposed on the entry side and on the exit side 19*a*;19*b* (FIG. 2) of the mould, by which the frames 7 carrying the block elements 5 are drawn onto the tracks 11 using the chains and are guided on them in such a way that the frames 7 slide over the stationary magnetic rails 12 and magnetic bows 13 without contacting them. Several chains 20 are possibly arranged over the width of the mould, the mutual distance of which is such that any undue bending of the frames 7 placed on said chains 20 and thus of the composite blocks 4 extending over the width of the mould is avoided, so that due to the low degree of deformation of the relatively small block elements 4 and to their definite, invariable position within the frames 7, practically even mould walls are achieved in spite of the temperature changes occurring during the passage through the mould, disregarding the length and the width thereof. The blocks 4 in the region of the top surface of the machine bodies 2;3 are lying free on the chains 20 so that, in case of an exchange of blocks, they can be removed and replaced easily by simply being lifted off by means of a hoisting equipment provided with a suitable gripper, without any necessity to spend additional time and work on detaching and refastening the blocks 4.

The dimension of the block elements 5 depends on the deformation admissible during the passage of the mould. According to the present invention, based on assays and on experience, the dimension of a block element 5 in the lateral direction should not exceed 25 cm (FIG. 3"*h*").

Figure 3:
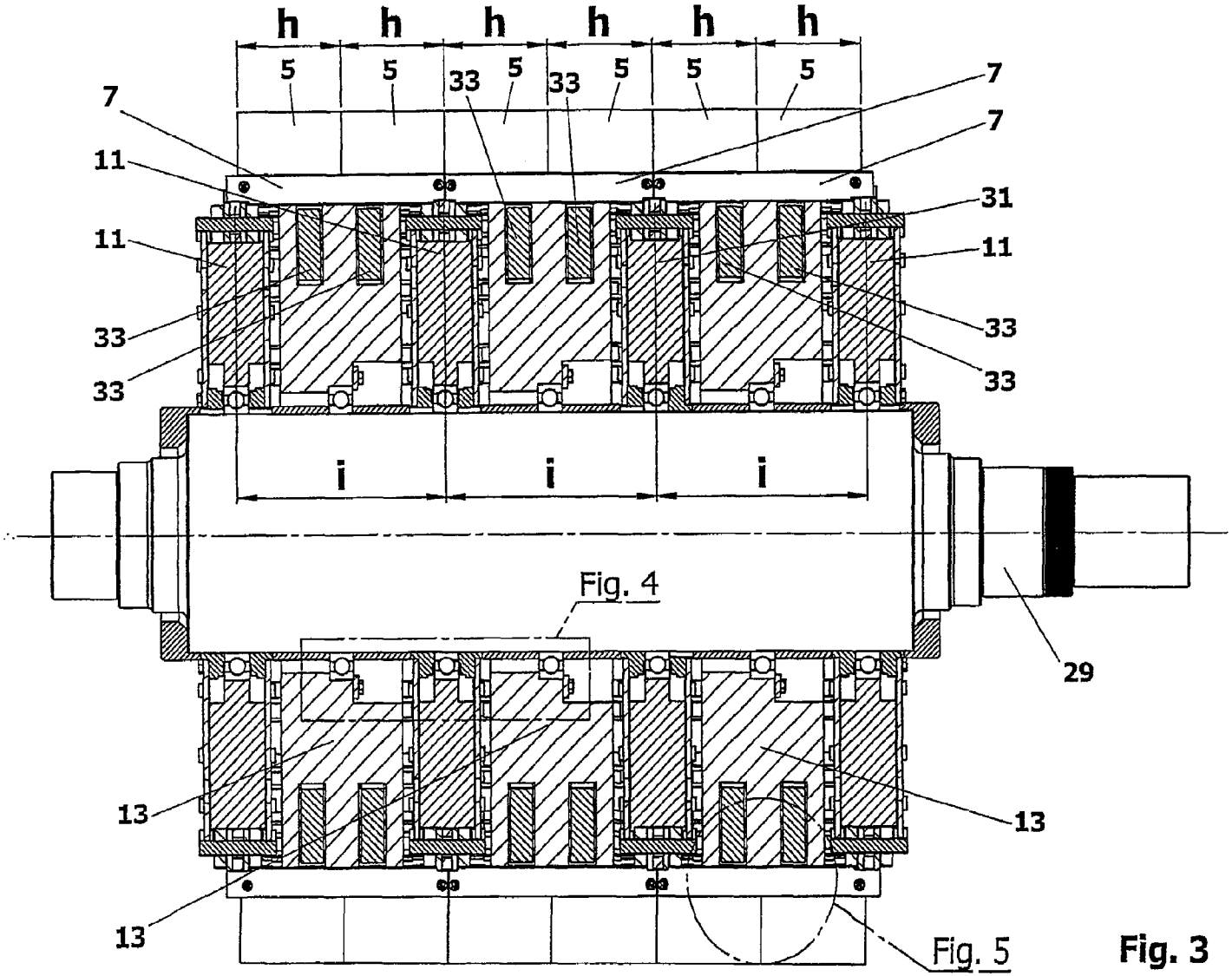
FIG. 3 shows a cross-section of a casting caterpillar at a right angle to the longitudinal direction, taken in the region of a driving axle including electromagnetic return bows and accessory electric conductors.
Figure 4:
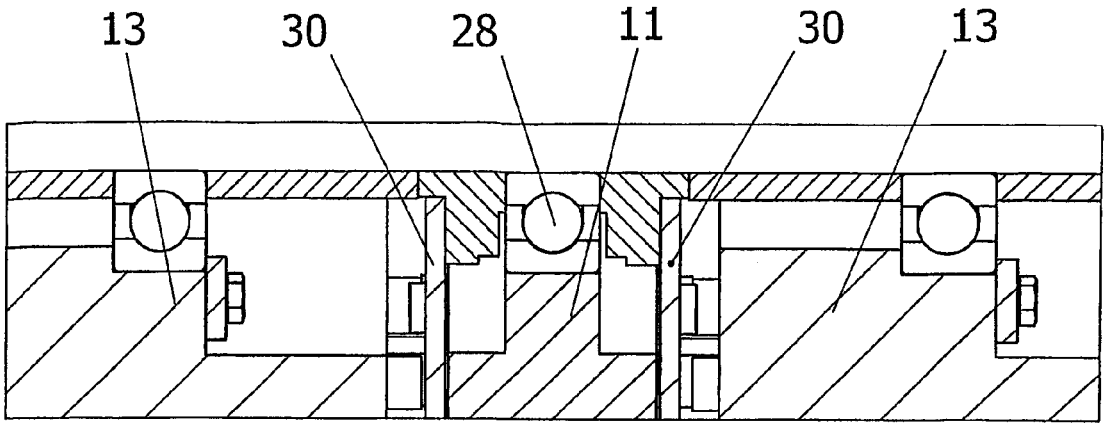
FIG. 4 shows an enlarged detail as indicated in FIG. 3.

According to the present invention, the maximum distance between the supports of the frames, i.e. in the present case the distance between two chains should not exceed 30 cm (FIG. 3"*j*").

Figure 5:
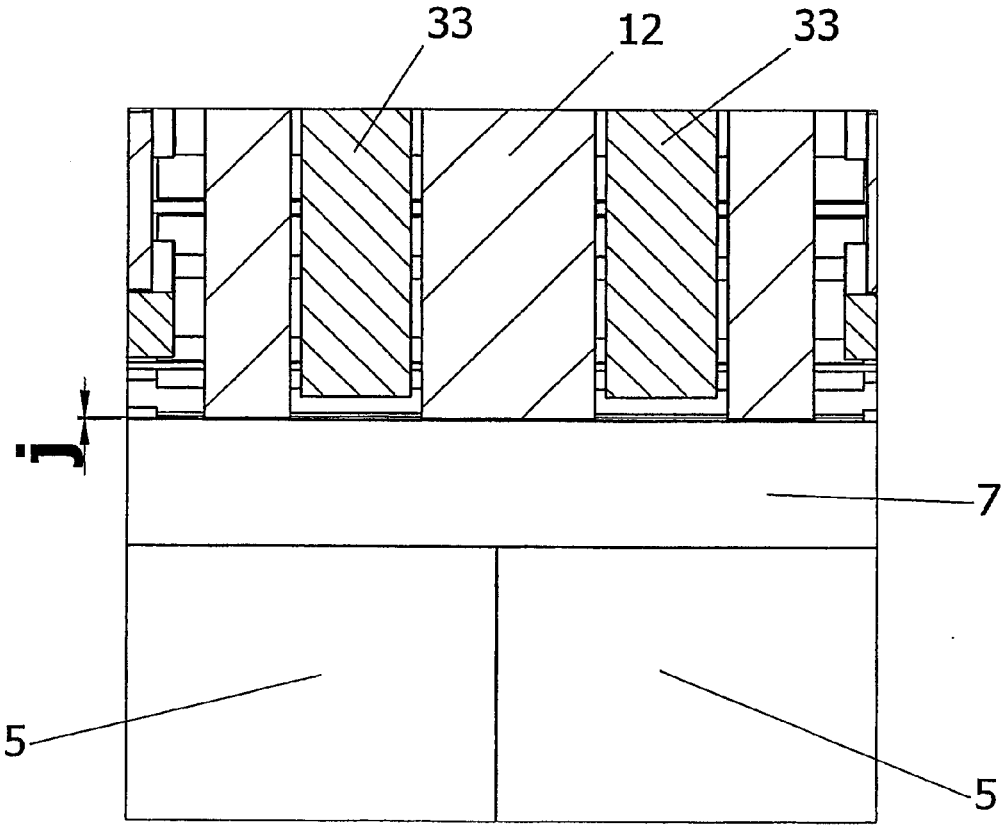
FIG. 5 shows an enlarged detail as indicated in FIG. 3.

The magnetic forces must be sufficient so as to securely maintain the weight of the blocks 4 on the bottom surface of the casting caterpillars 2;3 and on the magnetic bows 13 arranged on the entry side and on the exit side 19*a*;19*b* of the mould. This condition can only be met through a precise guiding of the frames 7 carrying the blocks 4 over the magnetic rails 12 and the magnetic bow 13, since the distance j between the latter and the frames 7 of the blocks 4 sliding over them must, for reasons of a purely physical nature, not exceed a few tenths of a millimeter (FIG. 5).

According to the present invention, the above-mentioned condition is fulfilled in that the stationary magnetic bows 13 and the bows of the tracks 11 of the chains 20 are provided with plain bearings or rolling bearings 28 and are positioned between the chain wheels 30 engaged with the chains 20, on the rotating drive shafts 29 thereof which are arranged on the entry and on the exit of the mould, which makes it possible to ensure the required concentricity of the magnetic bows 13 with the tracks 11 of the chains 20, as well as the precise position thereof with respect to the casting caterpillars 2;3 and to the chain wheels 30, so that the air gap between the magnetic bows 13 and the blocks 4 moving over them will not be affected, even if the drive shafts 29 are displaced on the machine body for adjustment of an optimal wave distance.

Figure 2:
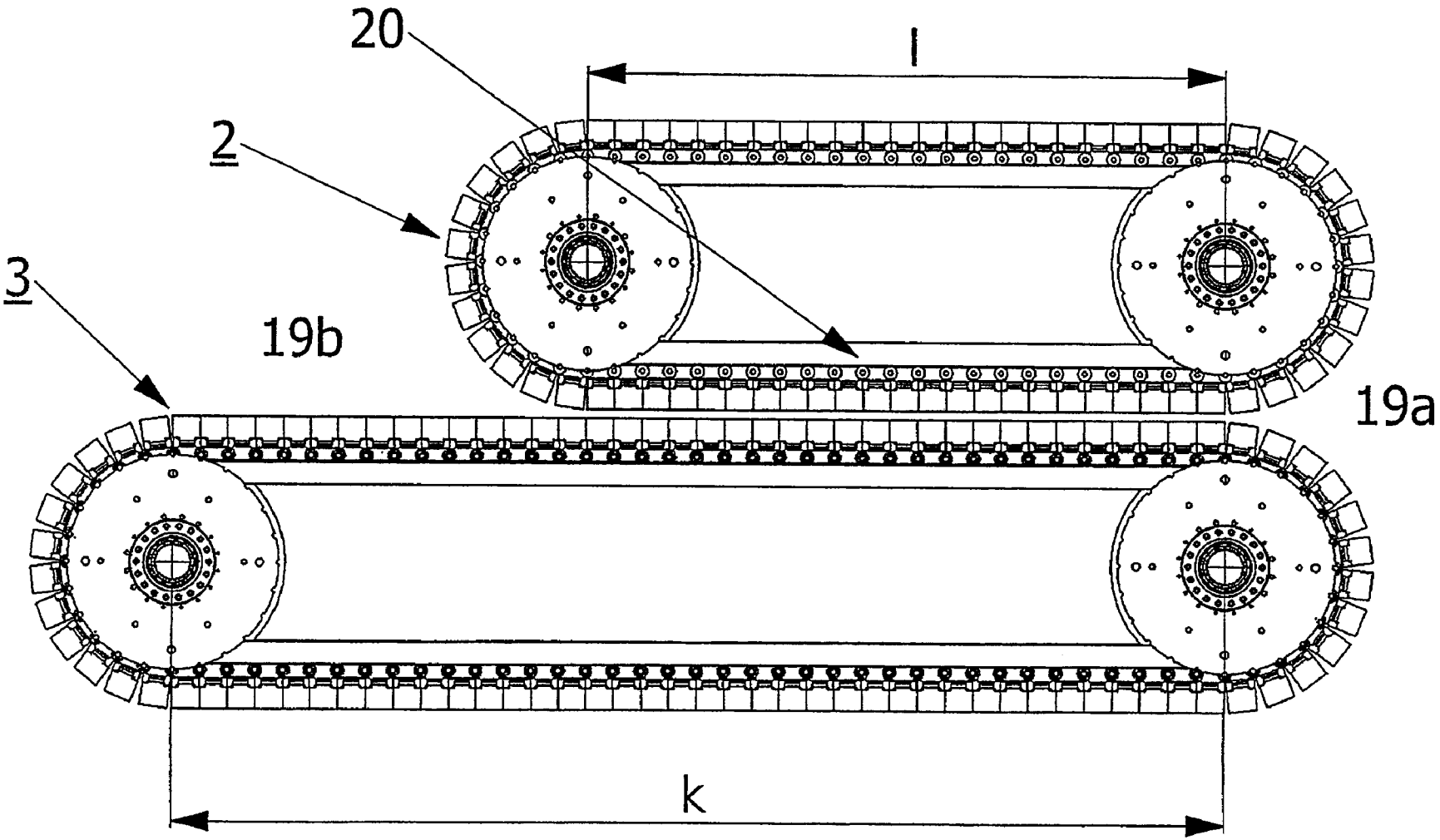
FIG. 2 shows a side view of the embodiment of the casting machine according to the present invention as represented in FIG. 1.

According to the present invention, the lower casting caterpillar 3 of machines with a horizontal or a slightly inclined casting direction has a greater length (FIG. 2"k") on the exit side 19*b* than the upper one (FIG. 2"l"), which makes it possible to exchange also the blocks 4 situated on the lower casting caterpillar 3 in a manner analogous to those situated on the upper one without any hindrance, as the machine drive is used to move them gradually onto said extended portion (FIG. 2 "k"-"l").

According to the present invention, an additional cooling appliance acting on the top side of the strand leaving the machine may be provided on the extended portion of the lower casting caterpillar 3 situated on the exit side, making it possible to considerably accelerate the exiting speed of the produced strand and thus to increase the capacity of the casting machine 1 as well as the service life of the blocks 4, as the latter will consequently have to absorb a smaller amount of heat.

The cooling action may be realised by blowing air on the surface of the product or by spraying a liquid coolant on it which is removed from the surface of the strand by suction in a manner known in the art and reintegrated into the cooling circuit. In order to change the blocks 4, the cooling appliance, which is preferably equipped with rollers and positioned on rails, is displaced in the casting direction by the distance required, thus ensuring the accessibility of the blocks 4.

With machines having a vertical or a strongly inclined casting direction the magnetic force of attraction in the apex of the bows is suspended over a distance of three or four blocks 4, so that in this specific zone the latter lie free on the chains 20, thus making it possible, by gradually advancing the chains 20, to remove and replace all blocks 4.

According to the present invention, the exchange of the blocks 4 is characterized in that a plate horizontally suspended on a hoisting equipment, provided on its bottom surface with sealings and connected to a vacuum system is let down on the blocks 4 to be exchanged, whereupon the vacuum system present between the plate and the blocks is activated by opening the respective valves so that the blocks 4 are aspirated by the plate and can thus be replaced in a small fraction of the expenditure in time and labour which had so far been necessary for this operation.

It is evident that in applying the invention disclosed herein, the conditions stated above under points (A) and (B) are met.

The utilisation of magnetic forces in continuous casting machines, which operate continuously, is well-known. U.S. Pat. No. 4,794,978 describes a side dam with articulate dam units which circulate on a closed track, the dam blocks consisting of a block support equipped with a permanent magnet and of an exchangeable block of a ferromagnetic material, the latter being attracted by said magnet and thus maintained on the support. The blocks rest firmly on the magnets which circulate along the entire track and, unlike in the present invention, are uninterruptedly exposed to the force of magnetic attraction. It is evident that in order to replace the blocks, these will have to be individually pulled off by force from their respective supports. In this device, a simultaneous replacement of a plurality of blocks is neither intended nor practically feasible. As the dam blocks must necessarily consist of a ferromagnetic material, a utilization of homogeneous blocks having a higher specific thermal conductivity, such as copper or aluminium, is not possible. Unlike this known application, the present approach according to the invention does not work with mobile magnets that accompany the blocks but with stationary magnetic rails 12 over which the blocks slide in a contactless manner, the magnetic rails 12 being interrupted on the top surface of the casting caterpillars 2;3, so that in this region the blocks 4 are not secured and are solely maintained on the chains 20 by virtue of their own weight so that their replacement takes only a very short time.

Another known application of magnetic forces in a caterpillar-mould casting machine consists, according to the disclosure DE 4121169AI, in the fact that, by means of devices present at both ends of the mould, the blocks forming the mould are turned by 180° from one side of the machine body to the track moving in the opposite direction, said blocks being seized by four magnets situated on a rotating cross and kept in place during the transport.

The design and the purpose of this application are once again clearly distinct from the invention described herein where no mobile magnetic bodies for the transportation of the blocks around the circulation path are used. With the machine design disclosed in the above-mentioned document, a group-by-group replacement of the block elements is neither intended nor practically feasible.

In the case of machines in which the mould is formed by thin mobile steel belts (also referred to as 'belt casters' in American terminology), an undesirable distortion of the belts due to a temperature increase on their passage through the casting zone can be compensated by means of magnetic forces (British Pat. No. 1,388,378, LX Pat. No. 79065).

It is evident that there is an essential difference in the purpose and the type of the known applications of magnets as compared to the present invention. The latter prevents the falling away of the blocks 4 which freely lie on the arcuate tracks arranged at the entry and exit of the casting zone and on the bottom surface of the casting caterpillars 2;3.

In order to achieve a considerably longer service life of the blocks 4, as compared to prior machines, the thermally-induced changes in internal tension to which said blocks are cyclically exposed must be reduced to a minimum in order to retard the formation of cracks on the front surface of the blocks 4 due to fatigue of the block material. As described above, the blocks 4 are held, according to the invention, in the frames 7 in such a way that at the occurrence of temperature variations they may be freely deformed in all three dimensions, so that the blocks 4 are not subject to any additional detrimental stresses due to external fixation forces exerted on them. This contributes to retard the fatigue of the block material and to achieve a longer service life.

According to one embodiment of the present invention, the cooling takes place exclusively on the rear surface of the blocks 4, so that the heat flow occurring in them will always move in the same direction, which leads to a considerable reduction of the difference between maximum and minimum temperatures on the critical block front surface and, as a consequence, the thermal stresses caused by temperature variations will equally turn out smaller, which makes it possible to achieve a considerably longer service life as compared to blocks that are prevented from free deformation and, in addition, are cooled on the front surface.

Practice has shown that the service life of the blocks 4 can further be greatly increased by applying a heat-insulating protective layer made of a ceramic material on the front surface.

According to the present invention, a considerably increased service life may be achieved by applying on the front surface of the blocks 4 a film with a thickness of some tenths of a millimeter, made for example of steel or titanium the strength of which exceeds by far that of the block material and which, due to a relatively low specific thermal conductivity, has the function of a heat throttle, so that the maximum temperature occurring on the surface of the underlying block material is reduced, which results in a corresponding weakening of the periodically occurring thermal stresses due to temperature changes and, therefore, of the material fatigue.

As stated above, a further increase in the service life of the blocks 4 may be achieved by providing a secondary cooling appliance for the cast strand that is to be arranged on the extended portion of the lower machine body.

By applying the measures disclosed herein, the condition stated above under point (C) is also fulfilled.

Figure 14:
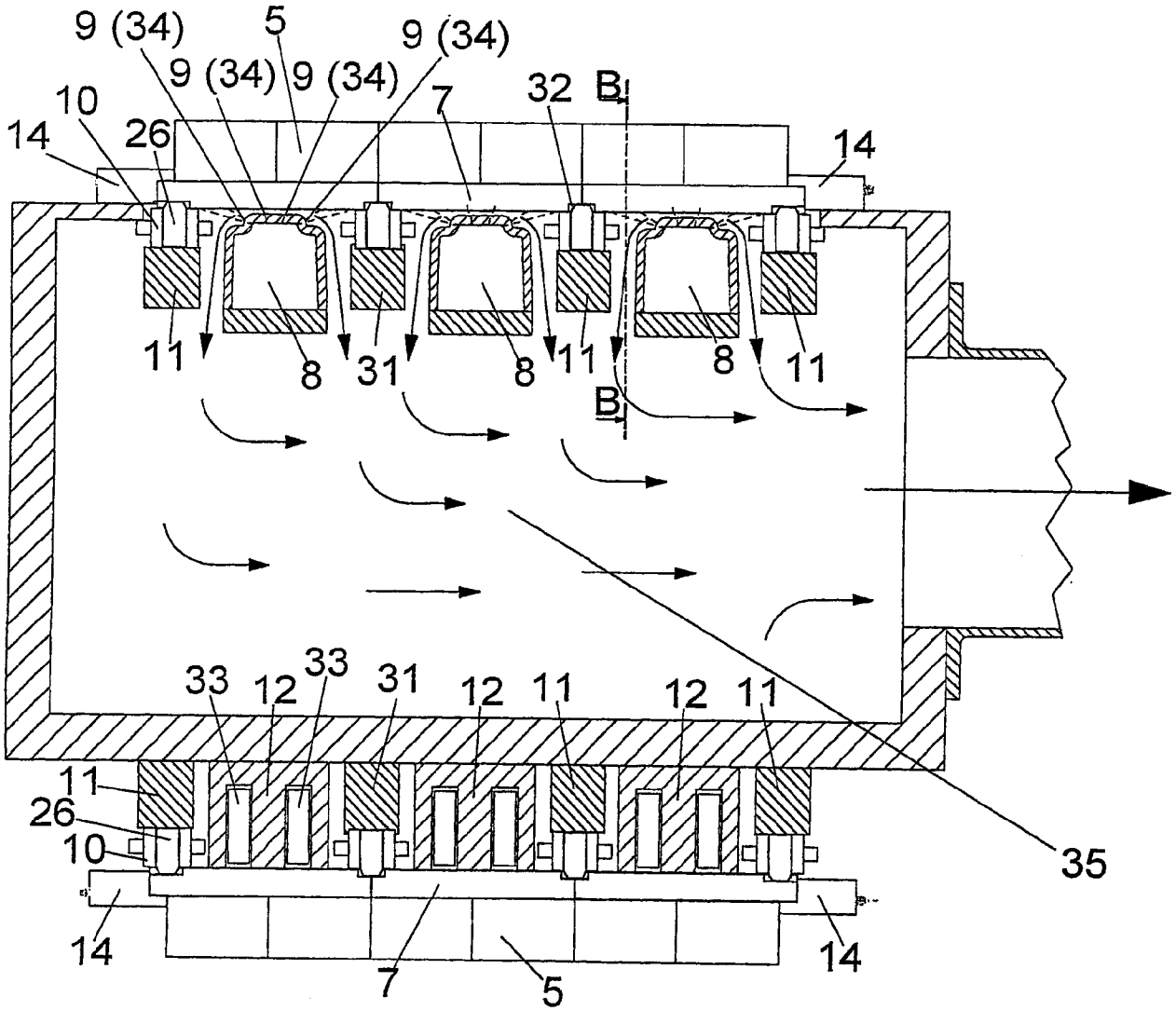
FIG. 14 shows a cross-section, taken at a right angle to the longitudinal direction, of the lower casting caterpillar of one embodiment of the casting machine according to the present invention.
Figure 15:
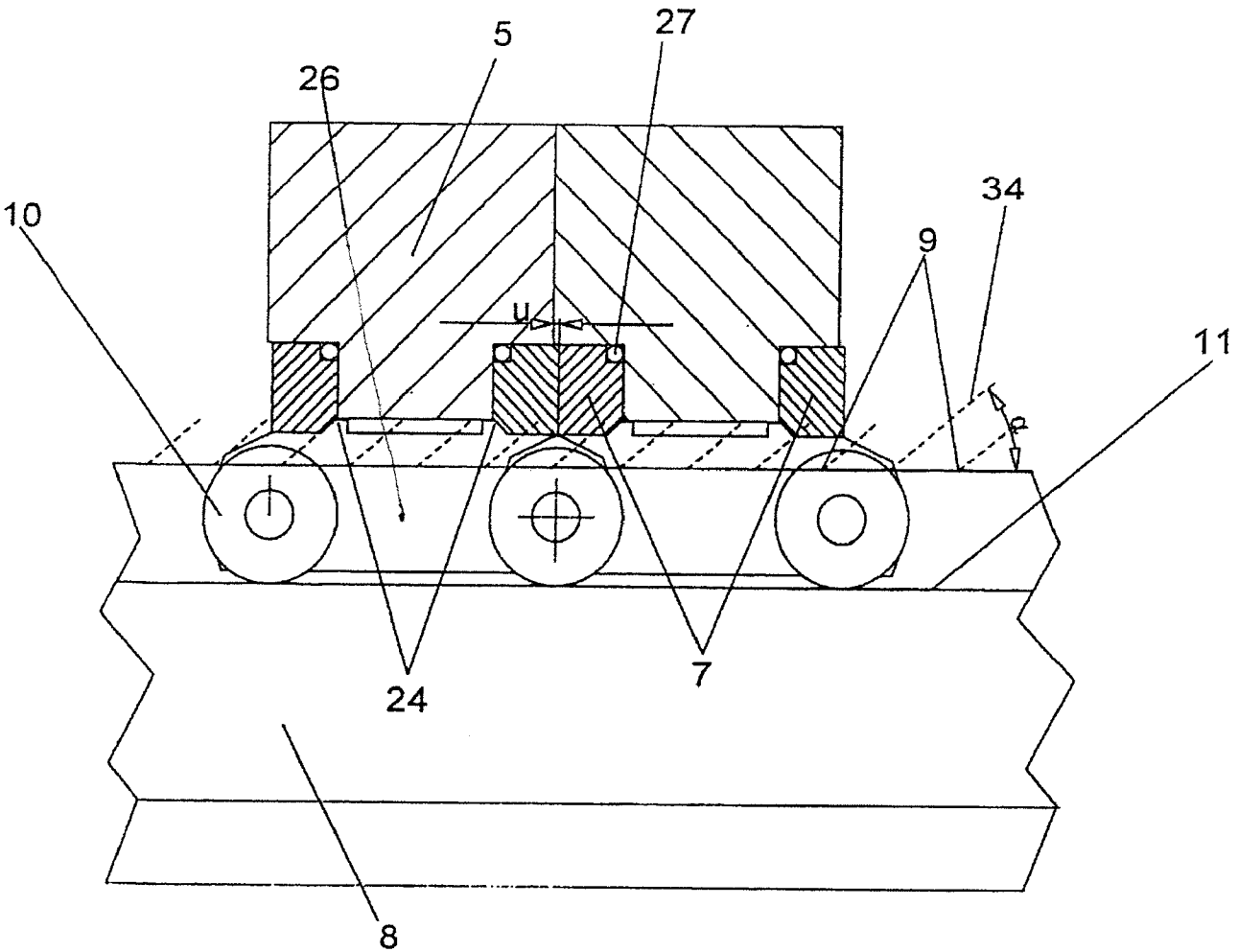
FIG. 15 shows a section along the line B-B of FIG. 14.

The cooling appliance of the blocks 4 of the machine described herein, shown in FIGS. 14 and 15, consists in the fact that the pressurised coolant is pumped into a box incorporated into the casting caterpillars 2;3 and extending over the width of the casting zone, and from there flows through coolant ducts 8 arranged on the top surface of the casting caterpillars 2;3 and extending parallel to the casting direction between the tracks of the chains 20, said ducts having nozzles 9 distributed over their lengths through which the coolant jet 34 is sprayed onto the rear surface of the blocks 4 so as to achieve a uniform cooling thereof.

According to the present invention, a plurality of nozzles 9 is oriented in such a way that the coolant jets 34 impart an impulsion in, or if necessary against, the casting direction to the blocks 4, depending on the most advantageous casting direction, which is imposed by the type of casting process used, in order to optimise in this way the clamping force between successive rows of blocks.

In order to prevent an undesired leakage of coolant from the casting caterpillars 2;3, the heated coolant is collected in a coolant reflux chamber 35, evacuated from the casting caterpillars 2;3 in a manner known in the art and, according to usual practice in casting plants, returned into a closed circuit consisting of an air separator, a heat exchanger, a coolant tank, pumps, filters, measuring and control devices etc.

The chains 20 carrying the blocks 4 are preferably provided with rollers 10 in order to reduce friction on the track 11 to a minimum. The rollers 10 of at least one chain 20 run on a track 31 provided with lateral guides by means of which the blocks 4 are laterally guided.

The chains 20 together with the blocks 4 resting thereon are driven by chain wheels 30 disposed on the entry side and on the exit side 19*a*; 19*b* of the mould beside the tracks 11, the shafts 29 of said chain wheels being connected with a speed controlled drive.

According to the present invention, the drive of the blocks 4 of the upper casting caterpillar 2 is provided on the exit side 19*b* of the mould, so that on the bottom surface, i.e. in the region of the mould, the blocks 4 are sealingly pressed against one another by virtue of the weight of the blocks 4 situated on the arcuate track at the entry side of said mould, an adequate angular momentum against the direction of rotation—depending on the friction between the chains 20 and the track 11 and on the inclination of the mould—being imparted to the shaft 29*a* supporting the chain wheels 30 on the entry side 19*a* in order to reduce the force exerted between the individual rows of blocks lying on one another within the mould to a required and acceptable amount.

According to the present invention, the same effect is achieved on the lower machine body 3 in that the drive shaft 29*c* of the chains 20 is situated on the entry side 19*a* of the mould and an adequate antitorque moment is imparted to the shaft 29*d* disposed on the exit side 19*b* and supporting the chain wheels 30 so that in the region of the mould the block rows abut on each other and thus come to lie tightly against one another.

Although the relatively small block elements 5 change only slightly in dimension when a temperature change occurs, this fact must nonetheless be taken into consideration.

According to the present invention, this problem is solved in that the joints of the chain links 26 are provided with a clearance extending in the longitudinal direction so that the pitch of the chains 20 may adapt itself to the dimensions of the blocks 4, both in their cold state and in their heated condition on passing through the mould, and to the toothing of the chain wheels 30.

In the kind of drive described above, the blocks 4, depending on their temperature, may be pulled apart on the side of the casting caterpillars 2;3 opposite the mould, due to the clearance existing in the joints of the chains 20, giving thus rise to an interspace between the successive blocks 4.

According to the present invention, the blocks 4 are therefore offset in their frames 7 by a measure u (FIGS. 6 and 15), so that said interspace will always be bridged, making sure that in the cooling zones the coolant will be prevented from passing between the blocks 4 and onto the mould surface.

Figure 16:
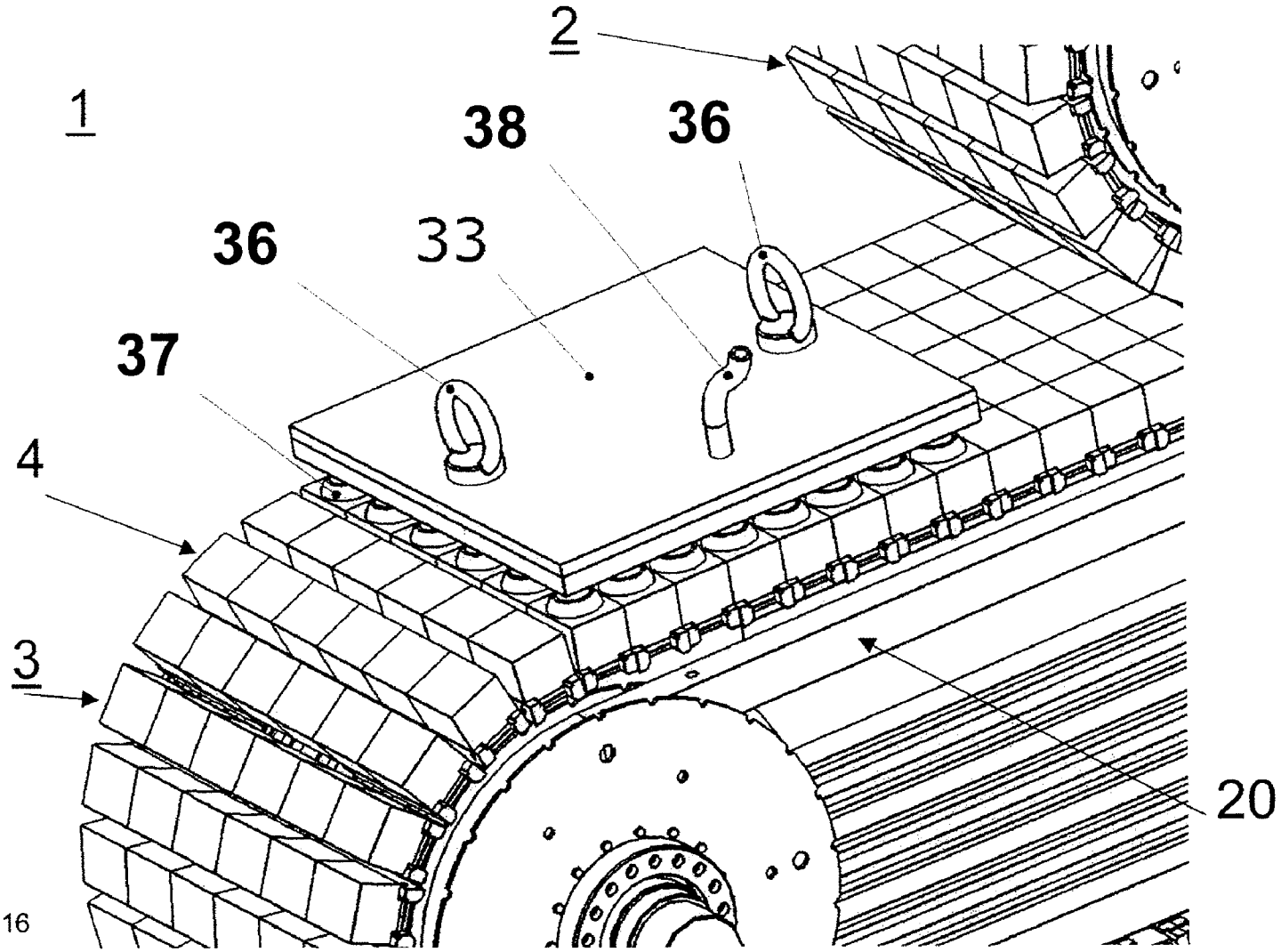
FIG. 16 is a perspective view of a casting machine showing a method of exchanging blocks.

It is evident that the blocks 4, which rest on the chains 20 without being fixed thereon, need to be secured against displacement on their respective chain link 26. FIG. 16 schematically illustrates the method of exchanging the blocks 4 of the casting machine 1. The blocks 4 in the region of the top surface of the machine bodies 2;3 lie free on the chains 20 so that, in case of an exchange of blocks, they can be removed and replaced easily by simply being lifted off by means of hoisting equipment provided with a suitable gripper, without any necessity to spend additional time and work on detaching and refastening the blocks 4. A plate 33 comprising two suspension rings 36 for being suspended on hoisting equipment (not shown) is provided on its bottom surface with sealings 37 which are connected to a vacuum tube 38. The vacuum tube 38 is connected to a vacuum system (not shown). The plate 33 is let down on the blocks 4 to be exchanged, whereupon the vacuum system is activated so that the blocks 4 are aspirated by the plate 33 and can thus be replaced in a small fraction of the expenditure in time and labor which has so far been necessary for this operation.

According to the present invention, the chain links 26 have a toothing which fittingly engages with the blocks 4 so that the position of the latter on the circulating chains 20 is defined and secured.

The invention claimed is:

1. A caterpillar casting method for a continuous fabrication of billets and bands of metallic or non-metallic materials comprising the step of:

casting in a casting mold which is formed by blocks (4) which circulate caterpillar-like on a transport means around a casting caterpillar (2;3) and are held at least on a portion t of the circulation path U, where they would fall off said transport means due to gravity, on said transport means by means of stationarily fixed magnets.

2. A casting method as claimed in claim 1, wherein the mold comprises an upper arid a lower casting caterpillar (2;3).

3. A casting method as claimed in claim 1, wherein the ratio between the portion t on which the blocks (4) are held on the transport means by means of stationary magnets and the total circulation path U of the at least one casting caterpillar (2;3), t: U, is between 0.55 and 0.95.

4. A casting machine (1) for carrying out the method as claimed in claim 1, wherein the continuous fabrication of billets and bands of metallic and non-metallic materials is done with a mold in which at least one wall consists of blocks (5) which circulate caterpillar-like around at least one casting caterpillar (2;3), whereby the blocks (4) lay loosely on a transport means, so that upon temperature changes they may be deformed in all directions, said blocks being pulled at least on a portion of the circulation path of the at least one casting caterpillar (2;3) by means of stationary magnets against tracks (31) and guided by the transport means so that the blocks (4) are movable in a contactless manner over the stationary magnets.

5. A casting machine (1) as claimed in claim 4, wherein the magnets are permanent magnets or electromagnets.

6. A casting machine (1) as claimed in claim 4, wherein

A) the blocks (4) extending over the width of the mold consist, in the lateral direction, of several block elements (5) which are positioned in frames made of a ferromagnetic material (7) and are held together by means of drawbars (16) provided with tension springs (15) in such a way that, upon temperature changes occurring during the casting process, they may be freely deformed;

B) the blocks (4) put together by means of the frames (7) rest on the casting caterpillars (2;3) as a unit, C) at least one stationary magnetic rail (12) being arranged between tracks (11) of the transport means and the mold section at the lower path of the at least one casting caterpillar (2;3) and at least one stationary magnetic bow (13) being arranged on the entry side and on the exit side (19*a*; 19*b*) of the mold, by which the frames (7) carrying the block elements (5) are pulled onto the tracks (11) by means of the transport means and are guided thereon in such a way that the frames (7) are movable in a contactless manner over the stationary magnetic rails (12) and magnetic bows (13).

7. A casting machine (1) as claimed in claim 6, wherein over the width of the mold several transport means, are arranged, the lateral distance ("j") therebetween being such that any undue bending of the frames (7) placed on the transport means and thus of the composite blocks (4) extending over the width of the mold is avoided, so that due to the low degree of deformation of the block elements (5) and to their maintained, planar position within the frames (7) the walls of the mold, disregarding its length and its width, remain practically even, in spite of the heating of the blocks (4).

8. A casting machine (1) as claimed in claim 4, wherein at least on a portion of a top surface of machine bodies, the blocks (4) lie free on the transport means (20) and can be removed and replaced without any additional expenditure in time and labor in the course of an exchange operation carried out by means of hoisting equipment, provided with an adequate gripper.

9. A casting machine (1) as claimed in claim 6, wherein the frames (7) are made of a ferromagnetic material.

10. A casting machine (1) as claimed claim 4, wherein the transport means are chains (20).

11. A casting machine (1) as claimed in claim 4, wherein the transport means are provided with rollers (10).

12. A casting machine (1) as claimed in claim 6, wherein the length of the block elements (5), as measured in the lateral direction, is 25 cm ("h") at the most.

13. A casting machine (1) as claimed in claim 6, wherein the distance between the transport means carrying the frames (7) is 30 cm ("j") at the most.

14. A casting machine (1) as claimed in claim 4, wherein the casting machine has a horizontal or a slightly inclined casting direction and comprises a lower casting caterpillar (3) and an upper casting caterpillar (2), the lower casting caterpillar (3) having a length ("k") and the upper casting caterpillar (2) having a shorter length ("l") and being disposed in such a way that at an exit side of the mold, the lower casting caterpillar (3) juts out with respect to the upper casting caterpillar (2).

15. A casting machine (1) as claimed in claim 14, wherein a) the two casting caterpillars (2;3) each comprise two shafts (29*a*;29*b*;29*c*;29*d*) having concentrically fixed chain wheels (30);

b) the magnetic bows (13) being positioned by means of plain bearings or rolling bearings (28) on the rotating shafts (29) of the chain wheels (30), which makes it possible to ensure the required concentricity of the magnetic bows (13) with the track (11) of the transport means, as well as the precise position of these parts with respect to the machine bodies.

16. A casting machine (1) as claimed in claim 6, wherein the blocks (4) have a rear surface facing the tracks (11) and that a cooling appliance for said rear surface of the blocks (4) is provided.

17. A casting machine (1) as claimed in claim 4, wherein the blocks (4) have a front surface which forms the wall of the mold and which is provided with a heat-insulating protective layer, made of a ceramic material.

18. A casting machine (1) as claimed in claim 4, wherein the blocks (4) have a front surface which forms the wall of the mold and which is provided with a wear-resistant protective layer.

19. A casting machine (1) as claimed in claim 4, wherein the blocks (4) have a front surface which forms the wall of the mold and which is provided with a film made of titanium or steel and/or its alloys.

20. A casting machine (1) as claimed in claim 4, wherein a cooling appliance for the blocks (4) is provided which comprises a plurality of nozzles (9) that are oriented in such a way that coolant jets (34) impart an impulsion in, or against, a casting direction to the blocks (4).

21. A casting machine (1) as claimed in claim 15, wherein the casting machine comprises a drive for the blocks (4) which is provided on the upper casting caterpillar (2) on the exit side (19*b*) of the mould, an angular moment against the direction of rotation being imparted to the shaft (29*a*) on an entry side (19*a*).

22. A casting machine (1) as claimed in claim 15, wherein the casting machine comprises a drive for the blocks (4) which is provided on the lower casting caterpillar (3) on an entry side (19*a*) of the mold and that an adequate antitorque moment is imparted to the shaft (29*d*) disposed on the exit side (19*b*) and supporting the chain wheels (30), SO that in the region of the mold the block rows abut on each other and thus come to lie tightly against one another.

23. A casting machine (1) as claimed in claim 10, wherein each chain (20) has chain links (26) connected to one another by means of joints, said joints being provided with a clearance extending in a longitudinal direction so that the pitch of the chains (20) may adapt itself to the dimensions of the blocks (4), both in their cold state and in their heated condition on passing through the mold.

24. A casting machine (1) as claimed in claim 20, wherein the blocks (4) are offset in their frames (7), so that any interspace arising between the blocks (4) is bridged, and thus the coolant will be prevented from passing onto the front surface of the blocks (4) forming the wall of the mould.

25. A casting machine (1) as claimed in claim 23, wherein the chain links (26) have a toothing which engages with the frames (7) of the blocks (4) so that the position of the latter on the circulating transport means is defined and secured.

26. A method of exchanging the blocks (4) of a casting machine as claimed in claim 4, wherein a plate suspended on a hoisting equipment, provided on its bottom surface with sealings and connected to a vacuum system is let down on the blocks (4) to be exchanged, whereupon the vacuum system is activated so that the blocks (4) are aspirated by the plate and can thus be replaced in a small fraction of the expenditure in time and labour which has so far been necessary for this operation.

* * * * *

UNITED STATES PATENT AND TRADEMARK OFFICE

CERTIFICATE OF CORRECTION

PATENT NO. : 7,614,441 B2
APPLICATION NO. : 10/597053
DATED : November 10, 2009
INVENTOR(S) : Lauener et al.

It is certified that error appears in the above-identified patent and that said Letters Patent is hereby corrected as shown below:

In Column 12, Line 2 (Claim 2, Line 2), after "upper," delete "arid" and insert --and--.

Signed and Sealed this

Twenty-second Day of December, 2009

David J. Kappos

David J. Kappos
*Director of the United States Patent and Trademark Office*